US010787801B1

(12) United States Patent
Lovins

(10) Patent No.: US 10,787,801 B1
(45) Date of Patent: Sep. 29, 2020

(54) TOILET VENTILATING APPARATUS

(71) Applicant: Ralph Lovins, Murphy, NC (US)

(72) Inventor: Ralph Lovins, Murphy, NC (US)

( * ) Notice: Subject to any disclaimer, the term of this patent is extended or adjusted under 35 U.S.C. 154(b) by 28 days.

(21) Appl. No.: 16/210,394

(22) Filed: Dec. 5, 2018

(51) Int. Cl.
*E03D 9/052* (2006.01)
*A47K 13/30* (2006.01)

(52) U.S. Cl.
CPC ..... *E03D 9/052* (2013.01); *A47K 13/307* (2013.01)

(58) Field of Classification Search
CPC ..... E03D 9/052; A47K 13/307
USPC ..... 4/217, 218
See application file for complete search history.

(56) References Cited

U.S. PATENT DOCUMENTS 4,800,596 A 1/1989 Menge
4,984,310 A * 1/1991 Casale ..... E03D 9/05 4/217
6,298,500 B1 * 10/2001 Sollami ..... A47K 13/307 4/217
7,644,450 B2 1/2010 Lapossy
2012/0255110 A1 * 10/2012 Kao ..... A47K 13/307 4/348

* cited by examiner

*Primary Examiner* — Tuan N Nguyen
(74) *Attorney, Agent, or Firm* — Sanchelima & Associates, P.A.; Christian Sanchelima; Jesus Sanchelima

(57) ABSTRACT

The present invention relates to a toilet ventilating apparatus. The apparatus comprises a toilet seat assembly which includes a bottom seat and a top seat, the toilet seat assembly being deployable on a toilet bowl; a plurality of apertures configured on the bottom seat; a plurality of apertures configured on the top seat; at least one duct in communication with the plurality of apertures; and a venting structure in communication with the at least one duct, the venting structure configured to exhaust odor containing air from the toilet bowl to an exterior of a lavatory via the plurality of apertures configured on the top seat, the plurality of apertures configured on the bottom seat and the at least one duct.

8 Claims, 5 Drawing Sheets

TOILET VENTILATING APPARATUS

BACKGROUND OF THE INVENTION

1. Field of the Invention

The present disclosure relates to the field of water closets or public lavatories. In particular, the present invention relates to ventilation means for being deployed in a water closet or public lavatories.

2. Description of the Related Art

Ventilation of obnoxious fumes from the lavatories is one of the most basic needs of decent living. To this end, exhaust fans have been used in the art, wherein the exhaust fans are mounted at a wall of the lavatory, which is exposed to the atmosphere at one of its sides. However, it is not always possible to use an exhaust fan, since some complicated constructions may often result in the lavatory walls not being exposed to the atmosphere.

Several designs for discreet toilet ventilation systems and apparatuses have been designed in the past. None of them, however, are known to have a compact configuration and a design that can be retro-fitted on the conventional toilet bowls as well.

Applicant believes that a related reference corresponds to U.S. Pat. No. 7,644,450 filed by KENNETH A. LAPOSSY. The Lapossy reference discloses a built-in to the toilet ventilation system, in which the active parts are contained in a simple housing that is removably attached to the side surface of the toilet base. However, the system disclosed in Lapossy reference requires a toilet bowl with a specific configuration in which vent holes are configured on the toilet bowl itself. As such, the system cannot be retro-fitted to the conventional toilet bowls.

Another related application is U.S. Pat. No. 4,800,596 filed by HEINRICH MENGE. The Menge reference discloses ventilation system having a pipe for evacuating odors from the bowl that leads from the bowl to the flush tank. This evacuating pipe has an open end in the bottom of the bowl and a second end in the tank. An air duct hooked into the waste line also extends into the tank and can be caused to communicate with the evacuating pipe when the toilet is in use. However, the system disclosed in the Menge reference requires the use of a flush tank with a specific construction, and as such cannot be retro-fitted to the conventional toilet bowls without changing the flush tank.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a toilet ventilation apparatus having a compact configuration.

It is yet another object of the present invention to provide a toilet ventilation apparatus that can be retro-fitted to the conventional toilet bowls.

It is yet another object of the present invention to provide a toilet ventilation apparatus that can be deployed in domestic lavatories as well as public lavatories.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
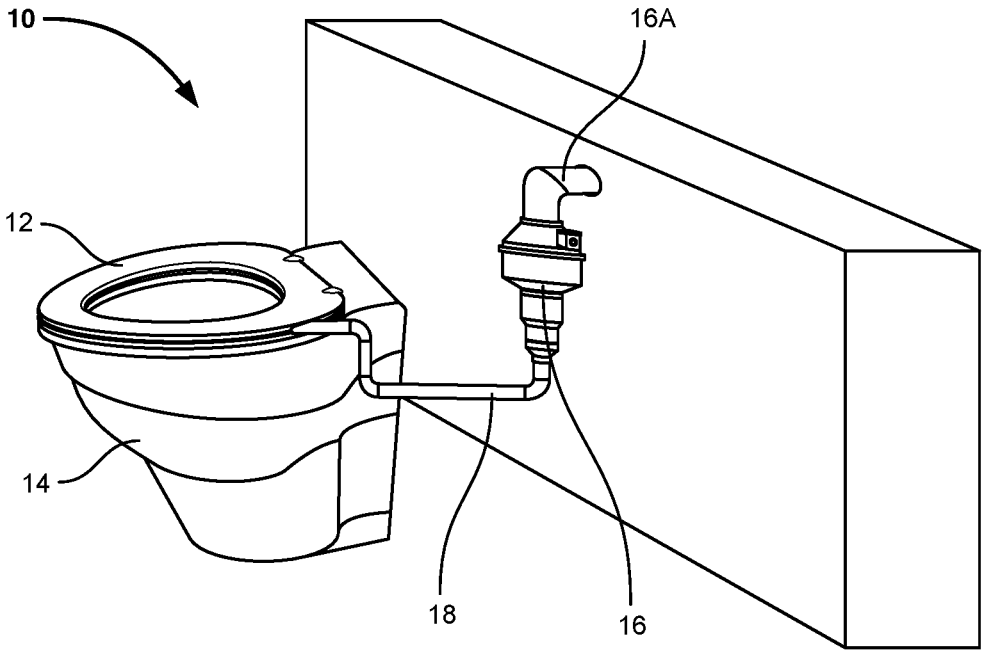
FIG. 1 illustrates an isometric view of a toilet ventilation apparatus 10, in accordance with an embodiment of the present invention, wherein the toilet ventilation apparatus 10 comprises a toilet seat assembly 12 disposed on a toilet bowl 14, and a venting means 16.

Referring now to FIGS. 1-5, where the present invention is generally referred to with numeral 10, it can be observed that a toilet ventilation apparatus 10 (hereinafter referred to as apparatus 10), in accordance with an embodiment of the present invention, container 10 comprises a toilet seat assembly 12 attached on a toilet bowl 14, and a venting means 16.

The apparatus 10, in accordance with an aspect of the present invention, has compact configuration that can be retro-fitted to the conventional toilet bowls as well. More specifically, in accordance with one aspect of the present invention, the apparatus 10 does not require any kind of components that have an application specific construction, and the apparatus 10 can be employed on any kind of conventionally available toilet bowls.

Furthermore, in accordance with another aspect of the present invention, the need of having a lavatory wall face the atmosphere on one side for mounting an exhaust fan is also overcome, the apparatus 10 does not involve the use of conventional wall mounted exhaust fans. As such, the apparatus 10 can be employed in establishments having a complicated construction, where the lavatory walls do not necessarily face the atmosphere.

Figure 4:
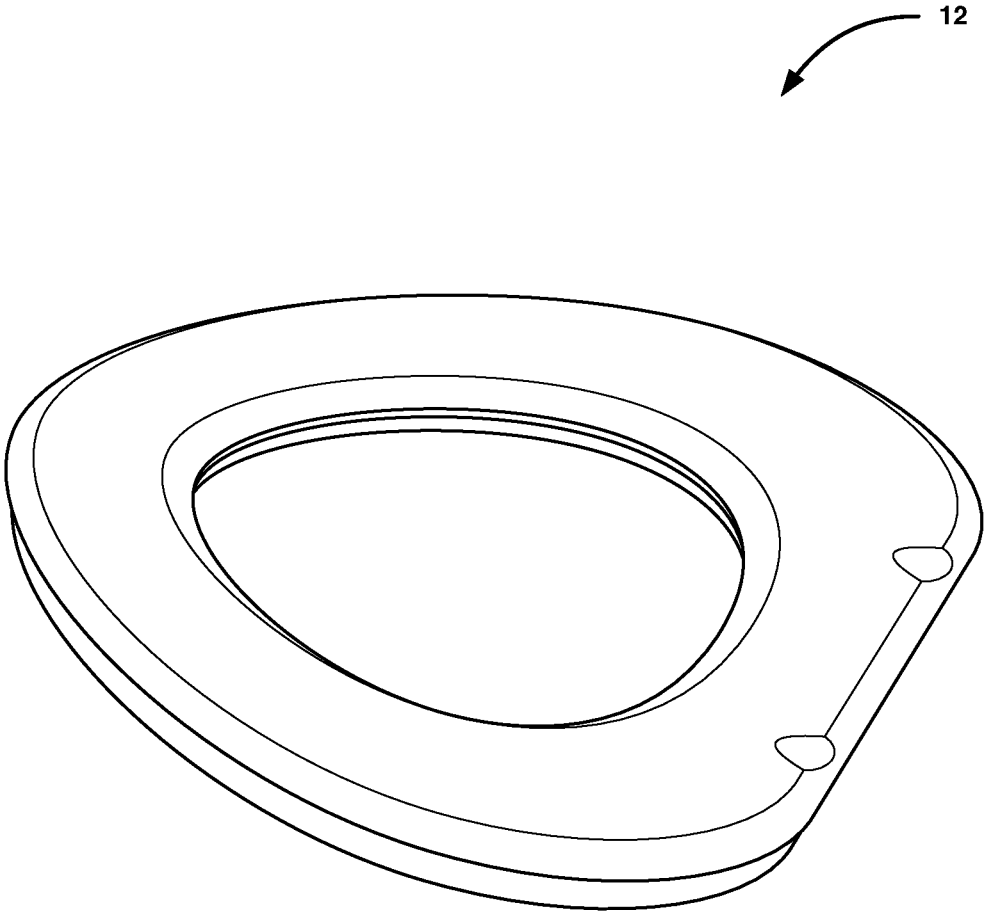
FIG. 4 illustrates an isometric view of the toilet seat assembly 10, wherein the top half 12A and the bottom half 12B are in an assembled configuration, in accordance with an embodiment of the present invention.

The apparatus 10 comprises the toilet seat assembly 12. Unlike the conventional toilet seats, the toilet seat assembly 12, in accordance with an embodiment of the present invention, comprises a top half 12A and a bottom half 12B. The assembly of the top half 12A and the bottom half 12B defines the toilet seat assembly 12, as can be seen in FIG. 4.

Figure 2:
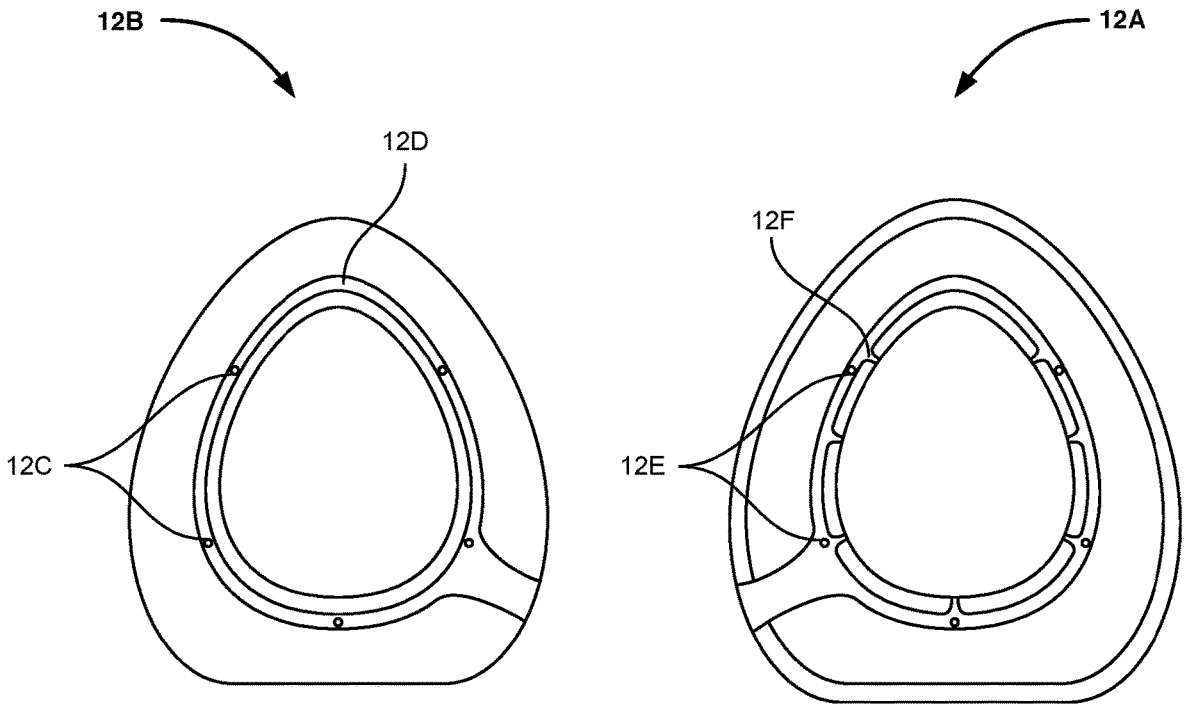
FIG. 2 illustrates bottom views of a top half 12A and a top view of a bottom half 12B of the toilet seat assembly 10, in accordance with an embodiment of the present invention.
Figure 3:
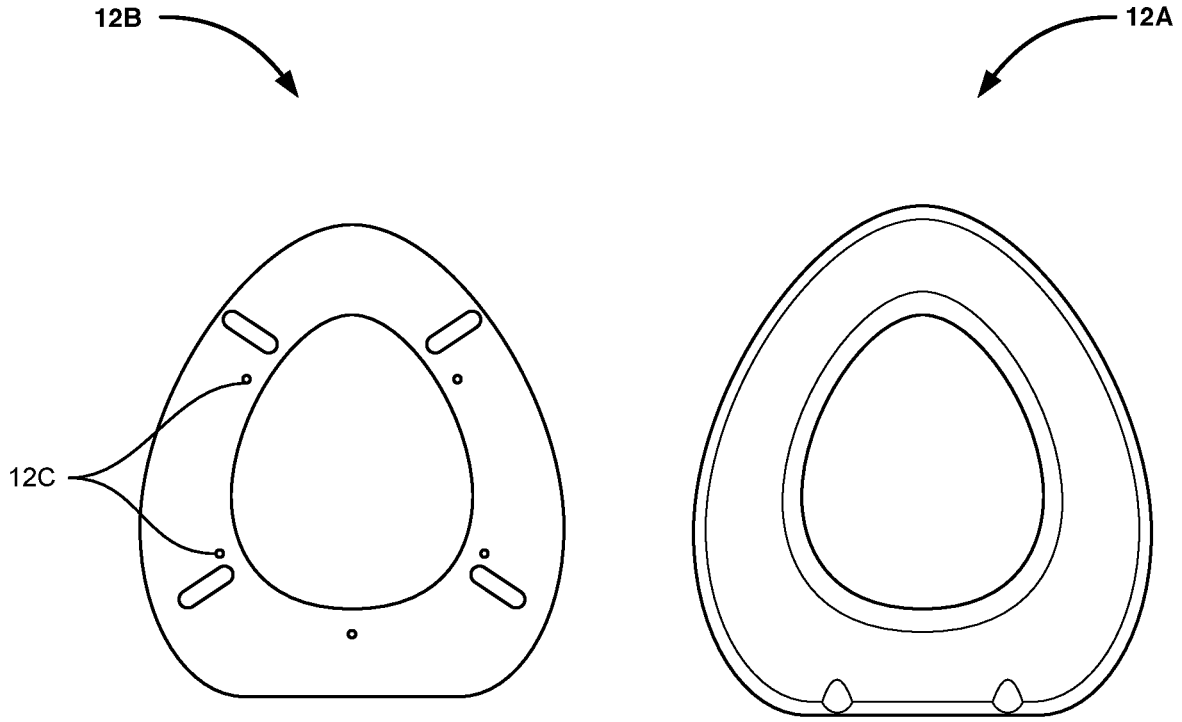
FIG. 3 illustrates a top view of the top half 12A and a bottom view of the bottom half 12B of the toilet seat assembly 10, in accordance with an embodiment of the present invention.

Reference is directed to FIGS. 2 and 3 hereinafter. The top half 12A has a plurality of apertures 12C configured on the top half 12A. The plurality of apertures 12C funnel into a channel 12D. The channel 12D extends on the bottom surface of the top half 12A, in accordance with an exemplary embodiment. Similarly, the bottom half 12B also has a plurality of apertures 12E configured thereon. The plurality of apertures 12E funnel into a channel 12F configured on the top surface of the bottom half 12B. When the top half 12A and the bottom half 12B are assembled, the channels 12D, 12F coincide to define an enclosed space that is in communication with the plurality of apertures 12C, 12E.

Figure 5:
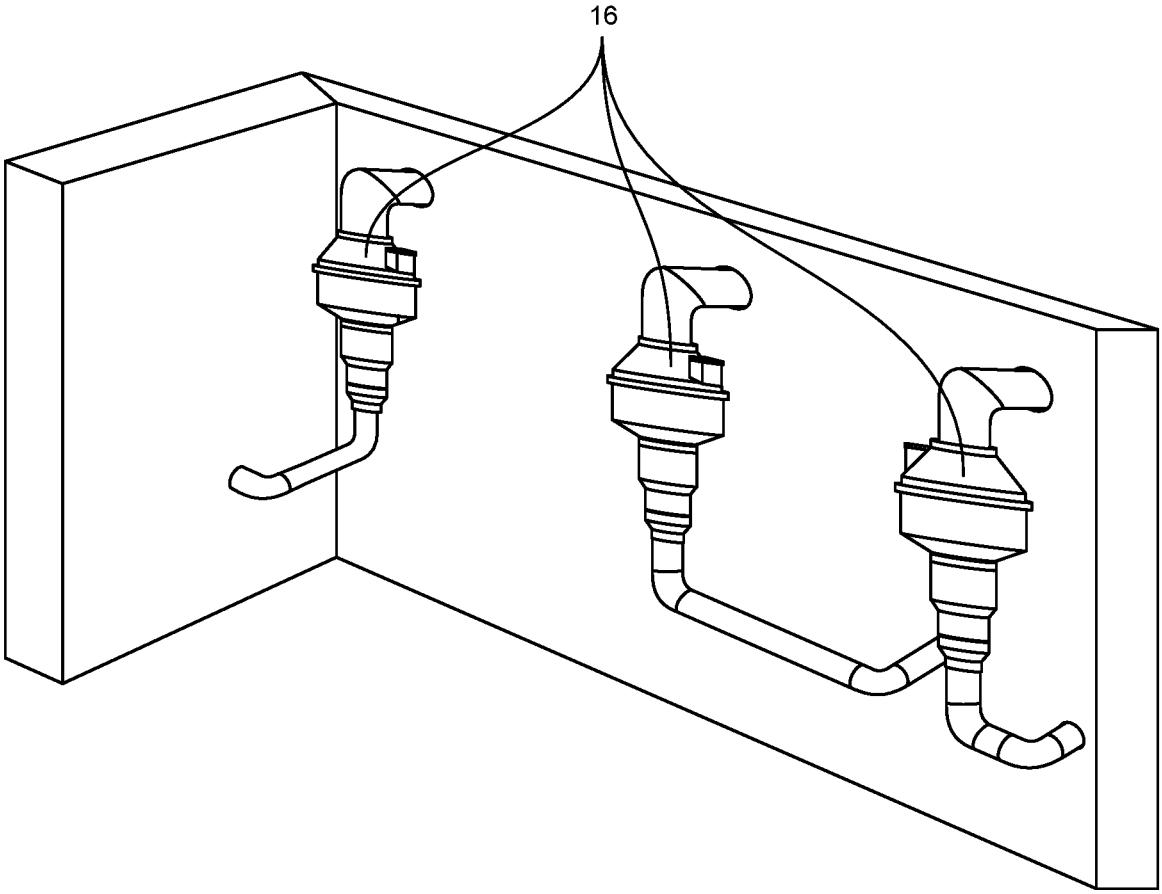
FIG. 5 illustrates a schematic isometric view of the venting means 16, in accordance with an embodiment of the present invention.

Reference is hereinafter directed to FIG. 1 and FIG. 5. The apparatus 10 further comprises at least one duct 18. The duct 18 extends from the toilet seat assembly 12. The duct 18 is in communication with the plurality of apertures 12C, 12E. At the other end of the duct 18, a venting means 16 is provided. The venting means 16, in accordance with one embodiment of the present invention, is an in-line exhaust fan. The advantage of the in-line exhaust fan is its compact size. Furthermore, the in-line exhaust fan or venting means 16 also includes an exhaust duct 16A that extends from the venting means 16. This duct 16A can be routed to the outermost wall of the establishment so that the outlet of the duct 16A opens directly to the atmosphere.

The apparatus 10 can further include a switch that is provided in the vicinity of the toilet bowl 14 so that the user can operate the venting means 16 at will. In one embodiment, the apparatus further comprises a timer in communication with the switch and the venting means 16. The timer is configured to operate the venting means 16 for a predetermined period of time once the switch is actuated by the user.

The apparatus 10 of the present invention can be used in domestic as well as public lavatories. FIG. 5 illustrates the schematic view of the venting means 16 that are mounted adjacent each other. Each of these venting means 16 can be associated with a one toilet bowl each, e.g., toilet bowls of a public lavatory.

The operative configuration of the apparatus 10 is hereinafter described. The function of the apparatus 10 is to vent out the obnoxious odors produced when an individual uses the toilet. To this end, the apparatus 10 is provided with the toilet seat assembly 12 having the plurality of apertures 12C, 12E formed on the top half 12A and the bottom half 12B. The venting means 16 is in communication with the apertures 12C, 12E via the duct 18. Once the user actuates the switch and turns on the venting means 16, suction of air takes place inside the toilet bowl 14 under the effect of the venting means 16, thereby causing the odor containing air from the toilet bowl 14 to be exhausted to the atmosphere.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A toilet ventilating apparatus comprising:

a. a toilet seat assembly which includes a top half and a bottom half, the toilet seat assembly being deployable on a toilet bowl;

b. a first set of apertures being circular in shape located on said top half, wherein said first sent of apertures funnel into a first channel extending on a bottom surface of said top half, wherein said first channel forms a complete circle on said first half;

c. a second set of apertures being circular in shape located on said bottom half, wherein said second set of apertures funnel into a second channel extending on a top surface of said bottom half, wherein said second channel forms a complete circle on said bottom half, wherein said top half and said second half are assembled and said first channel and said second channel define and enclosed space in communication with said first set of apertures and said second set of apertures;

d. at least one duct in communication with said first set of apertures and said second set of apertures; and e. a venting means in communication with the at least one duct, the venting means configured to exhaust odor containing air from the toilet bowl to an exterior of a lavatory via the first set of apertures and the second set of apertures.

2. The apparatus of claim 1, wherein the lavatory is a public lavatory comprising a plurality of toilet bowls.

3. The apparatus of claim 2, wherein at least one toilet bowl from the plurality of toilet bowls include the toilet seat assembly.

4. The apparatus of claim 1, wherein the venting means is an exhaust fan.

5. The apparatus of claim 4, wherein the exhaust fan is an in-line exhaust fan.

6. The apparatus of claim 1, further comprises a switch provided in the vicinity of the toilet bowl for allowing the user to turn on the venting means at will.

7. The apparatus of claim 6, further comprises a timer in communication with the switch and the venting means, the timer configured to operate the venting means for a predetermined period of time.

8. A system for a toilet venting apparatus, comprising:

a) a wall;

b) a venting structure being an in-line exhaust fan, said venting structure including an exhaust duct routed to said wall configured to open directly into an outside area of an establishment;

c) a toilet bowl;

d) a toilet seat assembly including a top half and a bottom half, wherein said top half includes a first set of apertures being circular in shape, wherein said first set of apertures funnel into a first channel extending on a bottom surface of said top half, wherein said first channel forms a complete circle extending an entire circumference of a center opening of said top half, wherein said bottom half includes a second set of apertures being circular in shape, wherein said second set of apertures funnel into a second channel configured on a top surface of said bottom half, wherein said second channel forms a complete circle extending an entire circumference of a center opening of said bottom half, wherein said top half and said bottom half are assembled, wherein said first channel and said second channel define an enclosed space that is in communication with said first set of apertures and said second set of apertures, a duct extending from said toilet seat assembly being in communication with said first said of apertures and said second said of apertures, said duct being connected to said venting structure, a timer in communication with said venting structure configured to actuate said venting structure at a predetermined time period.

* * * * *